US012292202B2

(12) United States Patent
Kim

(10) Patent No.: US 12,292,202 B2
(45) Date of Patent: May 6, 2025

(54) COLD AND HOT WATER SUPPLY AND POWER GENERATION SYSTEM INCLUDING GRAPHENE-COATED CERAMIC HEATING ELEMENT

(71) Applicant: GRAPHENE TECHNOLEGE CO., LTD, Incheon (KR)

(72) Inventor: Oun Hag Kim, Hwaseong-si (KR)

(73) Assignee: GRAPHENE TECHNOLEGE CO., LTD, Incheon (KR)

( * ) Notice: Subject to any disclaimer, the term of this patent is extended or adjusted under 35 U.S.C. 154(b) by 0 days.

(21) Appl. No.: 18/818,766

(22) Filed: Aug. 29, 2024

(65) Prior Publication Data

US 2025/0085000 A1 Mar. 13, 2025

Related U.S. Application Data

(63) Continuation of application No. PCT/KR2024/011355, filed on Aug. 1, 2024.

(51) Int. Cl.

| | |
|---|---|
| ***F24D 12/00*** | (2006.01) |
| ***F24D 3/02*** | (2006.01) |
| ***F24D 18/00*** | (2022.01) |
| *F24D 101/60* | (2022.01) |

(52) U.S. Cl.
CPC ..... *F24D 18/00* (2022.01); *F24D 3/02* (2013.01); *F24D 2101/60* (2022.01)

(58) Field of Classification Search
CPC ..... F24D 2101/60; F24D 18/00
See application file for complete search history.

(56) References Cited

U.S. PATENT DOCUMENTS

| | | | | |
|---|---|---|---|---|
| 9,850,145 | B2 * | 12/2017 | Thomas | H10N 10/00 |
| 2020/0343430 | A1 * | 10/2020 | Hatasako | F01N 3/0205 |

FOREIGN PATENT DOCUMENTS

| | | | |
|---|---|---|---|
| KR | 10-2007-0077546 | A | 7/2007 |
| KR | 10-1653208 | B1 | 9/2016 |
| KR | 10-2018-0137718 | A | 12/2018 |
| KR | 10-2019-0100659 | A | 8/2019 |
| KR | 10-2021841 | B1 | 9/2019 |
| KR | 10-2021-0129875 | A | 10/2021 |
| KR | 102562918 | B1 | 8/2023 |
| KR | 10-2672005 | B1 | 6/2024 |

OTHER PUBLICATIONS

Office Action dated Feb. 9, 2024 issued in KR Appl. No. 10-2023-0119517.

* cited by examiner

*Primary Examiner* — Ko-Wei Lin
(74) *Attorney, Agent, or Firm* — NKL Law; Jae Youn Kim

(57) ABSTRACT

An embodiment of the present invention relates to a cold and hot water supply and power generation system including a graphene-coated ceramic heating element, which can control temperatures of cold and hot water based on the graphene-coated ceramic heating element and a heat pump, use power generated by thermoelectric power generation based on a temperature difference between the cold and hot water, and supply the cold and hot water to a demand source or use the same for cooling and heating.

1 Claim, 4 Drawing Sheets

COLD AND HOT WATER SUPPLY AND POWER GENERATION SYSTEM INCLUDING GRAPHENE-COATED CERAMIC HEATING ELEMENT

TECHNICAL FIELD

Embodiments below relate to a cold and hot water supply and power generation system including a graphene-coated ceramic heating element, which may control temperatures of cold and hot water based on a graphene-coated ceramic heating element and a heat pump, use power generated by thermoelectric power generation based on a temperature difference between the cold and hot water, and supply the cold and hot water to a demand source or use the same for cooling and heating.

BACKGROUND ART

In facilities that use hot and cold water, such as swimming pools and bathhouses, a facility such as a heat pump or a boiler is used to control a temperature of the water. Since water has a high specific heat, much energy is consumed in a process of heating/cooling a large amount of water to a desired temperature, and thus there is a problem that the energy usage of a facility that uses hot and cold water is inevitably very large.

Although various technologies, such as technologies for improving the thermal efficiency/coefficient of performance (COP) of the heat pump, technologies for increasing the efficiency of the boiler, and surface heating element technologies, have been developed and used, they may not provide a fundamental solution to energy consumption.

PRIOR ART

Patent Documents (Patent Document 0001) KR 10-1653208 B
(Patent Document 0002) KR 10-1791898 B
(Patent Document 0003) KR 10-2022-0032284 A

DISCLOSURE

Technical Problem

An object to be solved by one embodiment of the present invention is directed to providing a cold and hot water supply and power generation system including a graphene-coated ceramic heating element, which may generate hot water based on an electric heating element using graphene and generate cold water based on a heat pump to overcome limitations of conventional cold and hot water supply systems, and harvest energy by constituting a thermoelectric generator based on a temperature difference between the generated hot water and cold water.

Technical Solution

According to one embodiment, there is provided a cold and hot water supply and power generation system including a graphene-coated ceramic heating element, which includes a cold water tank configured to accommodate water therein, a hot water tank configured to accommodate water therein, a heat pump configured to transfer heat from the cold water tank to the hot water tank, a thermoelectric element unit configured to generate power based on a temperature difference in water accommodated in the cold water tank and the hot water tank, the graphene-coated ceramic heating element configured to heat the water accommodated in the hot water tank, and an energy storage system (ESS) configured to store power generated by the thermoelectric element unit.

Further, the heat pump may include a compressor configured to compress refrigerant, a first heat exchanger connected to the compressor and configured to transfer heat between the water supplied from the cold water tank and the refrigerant, a first water pipe configured to supply water from the cold water tank to the first heat exchanger, a second water pipe configured to supply water passing through the first heat exchanger to the cold water tank, a first pump connected to one side of the first water pipe or the second water pipe, a second heat exchanger connected to the compressor and configured to transfer heat between the water supplied from the hot water tank and the refrigerant, a third water pipe configured to supply water from the hot water tank to the second heat exchanger, a fourth water pipe configured to supply water passing through the second heat exchanger to the graphene-coated ceramic heating element, a fifth water pipe configured to supply water passing through the graphene-coated ceramic heating element to the hot water tank, and a second pump connected to one side of the third water pipe, the fourth water pipe, or the fifth water pipe, the thermoelectric element unit may include a thermoelectric element pad of which one surface is provided with a low-temperature portion and the other surface is provided with a high-temperature portion, a first heat-conducting portion attached to the low-temperature portion, a second heat-conducting portion attached to the high-temperature portion, a first convection pipe configured to receive water through a lower portion of the cold water tank, pass through the first heat-conducting portion, and discharge the water to an upper portion of the cold water tank, a second convection pipe configured to receive water through an upper portion of the hot water tank, pass through the second heat-conducting portion, and discharge the water to a lower portion of the hot water tank, a third pump connected to the first convection pipe, and a fourth pump connected to the second convection pipe.

In addition, a plurality of thermoelectric element pads may be disposed in a lattice shape of a predetermined m×n size (m, n: natural numbers), the first convection pipe may include a 1-1 convection pipe extending upward from the lower portion of the cold water tank, 1-2 convection pipes branched from an end portion of the 1-1 convection pipe into m pipes, disposed horizontally so that each branched pipe corresponds to any one row of the thermoelectric element pad, and passing through the first heat-conducting portion, and a 1-3 convection pipe merged from end portions of the plurality of 1-2 convection pipes and extending to be connected to the upper portion of the cold water tank, the second convection pipe may include a 2-1 convection pipe extending downward from the upper portion of the hot water tank, 2-2 convection pipes branched from an end portion of the 2-1 convection pipe into m pipes, disposed horizontally so that each branched pipe corresponds to any one row of the thermoelectric element pad, and passing through the second heat-conducting portion, and a 2-3 convection pipe merged from end portions of the plurality of 2-2 convection pipes and extending to be connected to the lower portion of the hot water tank.

In addition, the cold and hot water supply and power generation system may include a voltage measurement unit configured to measure a voltage of each of the thermoelectric element pads, and a controller connected to the voltage measurement unit to monitor the thermoelectric element unit, the controller may be controlled according to a control method including measuring the voltage of each of the thermoelectric element pads corresponding to a unique number specified on each of the thermoelectric element pads, verifying failure for each thermoelectric element pad column, verifying failure for each thermoelectric element pad row, verifying failure of the thermoelectric element pad based on a neighboring thermoelectric element pad, monitoring an amount of power generated from all thermoelectric element pads, and controlling the graphene-coated ceramic heating element and the first pump to the fourth pump based on the amount of power generation, the verifying of the failure for each thermoelectric element pad column may include a first column verifying operation of specifying the 1-1 thermoelectric element pads disposed in the same column among the thermoelectric element pads disposed in the lattice shape based on the unique number; when the 1-2 thermoelectric element pads disposed at left sides of the 1-1 thermoelectric element pads with respect to the 1-1 thermoelectric element pads are present, a second column verifying operation of calculating a 1-1 ratio by comparing a total voltage of the 1-1 thermoelectric element pads with a total voltage of the 1-2 thermoelectric element pads; when the 1-3 thermoelectric element pads disposed at right sides of the 1-1 thermoelectric element pads with respect to the 1-1 thermoelectric element pads are present, a third column verifying operation of calculating a 1-2 ratio by comparing the total voltage of the 1-1 thermoelectric element pads with a total voltage of the 1-3 thermoelectric element pads; when the 1-1 ratio and the 1-2 ratio exceed a predetermined 1-1 reference ratio and 1-2 reference ratio, respectively, a fourth column verifying operation of recording unique numbers of the 1-1 thermoelectric element pads as defect verification targets, and a first repetition operation of repeatedly performing the first column verifying operation to the fourth column verifying operation on all columns of the thermoelectric element pad lattice based on the unique number, the verifying of the failure for each thermoelectric element pad row may include a first row verifying operation of specifying the 2-1 thermoelectric element pads disposed in the same row among the thermoelectric element pads disposed in the lattice shape based on the unique number; when the 2-2 thermoelectric element pads disposed above the 2-1 thermoelectric element pads with respect to the 2-1 thermoelectric element pads are present, a second row verifying operation of calculating a 2-1 ratio by comparing a total voltage of the 2-1 thermoelectric element pads with a total voltage of the 2-2 thermoelectric element pads; when the 2-3 thermoelectric element pads disposed under the 2-1 thermoelectric element pads with respect to the 2-1 thermoelectric element pads are present, a third row verifying operation of calculating a 2-2 ratio by comparing the total voltage of the 2-1 thermoelectric element pads with a total voltage of the 2-3 thermoelectric element pads; when the 2-1 ratio and the 2-2 ratio exceed a predetermined 2-1 reference ratio and 2-2 reference ratio, respectively, a fourth row verifying operation of recording unique numbers of the 2-1 thermoelectric element pads as defect verification targets, and a second repetition operation of repeatedly performing the first row verifying operation to the fourth row verifying operation on all rows of the thermoelectric element pad lattice based on the unique number, the verifying of the failure of the thermoelectric element pad may include a first adjacency verifying operation of recording thermoelectric element pads disposed at an outermost portion among the thermoelectric element pads disposed in the lattice shape based on the unique number as defect verification targets, a second adjacency verifying operation of specifying a 3-1 thermoelectric element pad that is any one of the thermoelectric element pads recorded as the defect verification targets based on the unique number; when a 3-2 thermoelectric element pad disposed above the 3-1 thermoelectric element pad with respect to the 3-1 thermoelectric element pad is present, a third adjacency verifying operation of calculating a 3-1 ratio by comparing a voltage of the 3-1 thermoelectric element pad with a voltage of the 3-2 thermoelectric element pad; when a 3-3 thermoelectric element pad disposed under the 3-1 thermoelectric element pad with respect to the 3-1 thermoelectric element pad is present, a fourth adjacency verifying operation of calculating a 3-2 ratio by comparing the voltage of the 3-1 thermoelectric element pad with the voltage of the 3-3 thermoelectric element pad; when a 3-4 thermoelectric element pad disposed at a left side of the 3-1 thermoelectric element pad with respect to the 3-1 thermoelectric element pad is present, a fifth adjacency verifying operation of calculating a 3-3 ratio by comparing the voltage of the 3-1 thermoelectric element pad with a voltage of the 3-4 thermoelectric element pad; when a 3-5 thermoelectric element pad disposed at a right side of the 3-1 thermoelectric element pad with respect to the 3-1 thermoelectric element pad is present, a sixth adjacency verifying operation of calculating a 3-4 ratio by comparing the voltage of the 3-1 thermoelectric element pad with a voltage of the 3-5 thermoelectric element pad; when all of the calculated values of the 3-1 ratio to the 3-4 ratio exceed a predetermined 3-1 reference ratio to 3-4 reference ratio, a seventh adjacency verifying operation of recording a unique number of the 3-1 thermoelectric element pad as defect; and a third repetition operation of repeatedly performing the first adjacency verifying operation to the seventh adjacency verifying operation on all thermoelectric element pads based on the unique number.

In addition, the cold water tank and the hot water tank may each be provided with a temperature sensor, and the controlling of the graphene-coated ceramic heating element and the first pump to the fourth pump may include when the amount of power generation measured from all thermoelectric element pads is less than a first reference, adjusting a set temperature of the graphene-coated ceramic heating element to a first temperature; when the amount of power generation measured from all thermoelectric element pads is the first reference or more and less than a second reference, adjusting the set temperature of the graphene-coated ceramic heating element to a second temperature; when the amount of power generation measured from all thermoelectric element pads is the second reference or more and less than a third reference, adjusting the set temperature of the graphene-coated ceramic heating element to a third temperature; when the amount of power generation measured from all thermoelectric element pads is the third reference or more, adjusting the set temperature of the graphene-coated ceramic heating element to a fourth temperature; when operating times of the third pump and the fourth pump are less than a fourth reference, adjusting output power of each of the third pump and the fourth pump to a first RPM; when the operating times of the third pump and the fourth pump are the fourth reference or more, adjusting the output power of each of the third pump and the fourth pump to a second RPM; when a water temperature inside the cold water tank is lower than a fifth reference, adjusting output power of the first pump to a third RPM; when the water temperature inside the cold water tank is the fifth reference or higher, adjusting the output power of the first pump to a fourth RPM; when a water temperature inside the hot water tank is lower than a sixth reference, adjusting output power of the second pump to a fifth RPM; and when the water temperature inside the hot water tank is the sixth reference or higher, adjusting the output power of the second pump to a sixth RPM.

Advantageous Effects

According to one embodiment, a system capable of cooling, heating, hot water supply, cold water supply, and thermoelectric power generation by generating hot water and cold water can be configured.

In addition, energy can be harvested by generating electricity without a separate motor or rotational machine.

In addition, by raising a temperature of hot water based on a graphene-based heating element (water heater), a temperature difference between the cold water and the hot water can be maintained in a range of 50 to 60° C.

In addition, it is possible to increase the efficiency of the thermoelectric power generation based on the temperature difference between the cold water and the hot water.

In addition, by performing thermoelectric power generation using several hundreds of thermoelectric elements, an appropriate amount of power generation can be maintained even when some thermoelectric elements fail or a portion of a circuit has a problem.

In addition, the accurate location of the problematic thermoelectric element can be identified by monitoring the amount of power generation or a voltage.

In addition, when the amount of power generation is found not to be sufficient by monitoring the amount of power generation, it is possible to increase the temperature difference between the cold water and the hot water, match a contact surface temperature of the thermoelectric element with a temperature of the cold water or the hot water, or increase a flow amount of water flowing through a heat exchanger, thereby increasing or maintaining the amount of power generation.

In addition, by reducing the number of repetitions or a load in a process of detecting a problematic thermoelectric element among the thermoelectric elements, it is possible to reduce heat generation or power consumption of a device (controller).

MODES OF THE INVENTION

Figure 1:
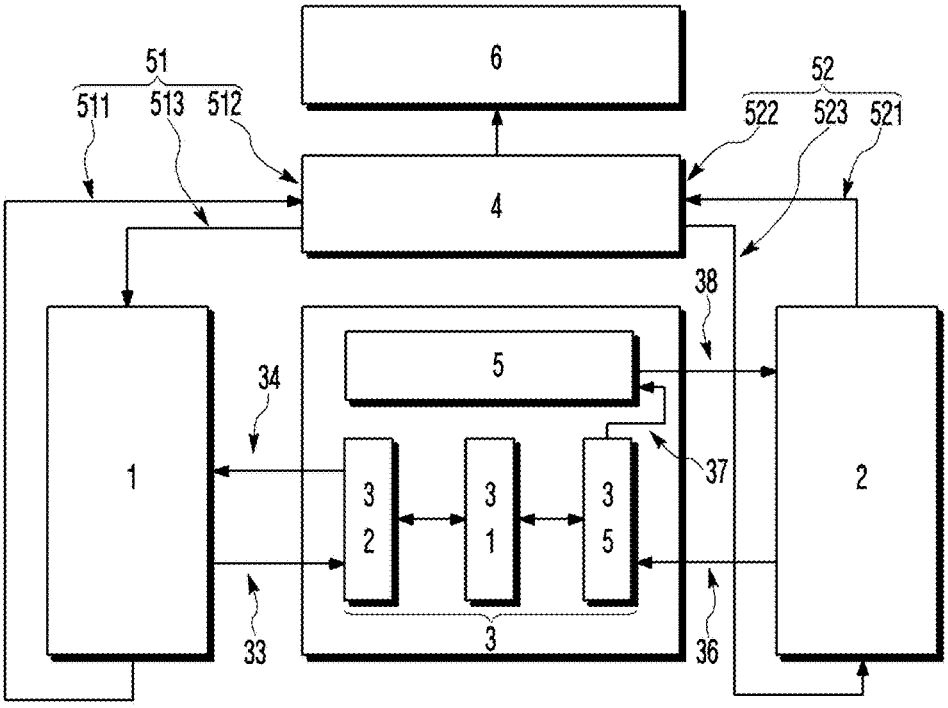
FIG. 1 is a systematic diagram showing a cold and hot water supply and power generation system including a graphene-coated ceramic heating element according to one embodiment of the present invention.
Figure 2:
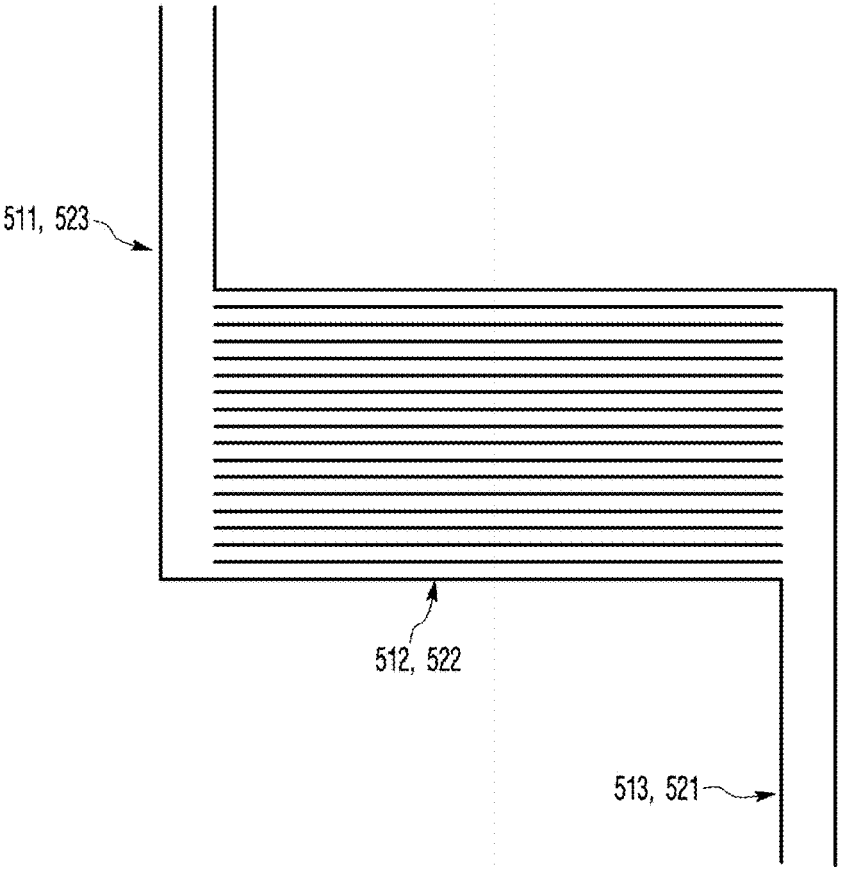
FIG. 2 is a view showing a convection pipe of the cold and hot water supply and power generation system including the graphene-coated ceramic heating element according to one embodiment of the present invention.

Hereinafter, embodiments will be described in detail with reference to the accompanying drawings. However, the embodiments may be modified in various ways, and the scope of the patent application is not limited or restricted by these embodiments. It should be understood that all modifications, equivalents, or substitutes to the embodiments are included in the scope.

Specific structural or functional descriptions of the embodiments are disclosed for the purpose of illustration only and may be changed in various forms when carried out. Therefore, the embodiments are not limited to a specific disclosed form, and the scope of the present specification includes modifications, equivalents, or substitutes included in the technical spirit.

Although the terms "first," "second," etc. may be used to describe various components, these terms should be construed only for the purpose of distinguishing one component from another. For example, a first component may be referred to as a second component, and similarly, a second component may also be referred to as a first component.

When a certain component is described as being "connected" to another component, it should be understood that the certain component may be directly connected or coupled to the other component, or other components may be present therebetween.

The terms used in the embodiments are used for the purpose of description only and should not be construed as limiting. The singular includes the plural unless the context clearly dictates otherwise. In the specification, it should be understood that terms such as "comprise" or "have" are intended to specify that a feature, a number, a step, an operation, a component, a part, or a combination thereof described in the specification is present, but do not preclude the possibility of the presence or addition of one or more other features, numbers, steps, operations, components, parts, or combinations thereof in advance.

Unless defined otherwise, all terms used herein, including technical or scientific terms, have the same meaning as commonly understood by those of ordinary skill in the art to which the embodiments pertain. Terms such as those defined in a commonly used dictionary should be construed as having meanings consistent with their meanings in the context of the related art and should not be construed with ideal or excessively formal meanings unless explicitly defined in the application.

In addition, in describing the embodiments with reference to the accompanying drawings, the same components are denoted by the same reference numerals throughout the drawings, and overlapping descriptions thereof will be omitted. In describing the embodiments, when it is determined that the detailed description of a related known technology may unnecessarily obscure the gist of the present invention, detailed description thereof will be omitted.

Advantages and features of the present invention and methods for achieving them will become clear with reference to embodiments described below in detail together with the accompanying drawings. However, the present invention is not limited to the embodiments disclosed below but can be implemented in various different forms, the embodiments are merely provided to make the disclosure of the present invention complete and fully inform those skilled in the art to which the present invention pertains of the scope of the present invention, and the present invention is only defined by the scope of the appended claims.

In the embodiments of the present invention, unless defined otherwise, all terms used herein, including technical or scientific terms, have the same meaning as commonly understood by those skilled in the art to which the present invention pertains. Terms such as those defined in a commonly used dictionary should be construed as having meanings consistent with their meanings in the context of the related art and should not be construed with ideal or excessively formal meanings unless explicitly defined in the application. Since shapes, sizes, ratios, angles, numbers, and the like disclosed in the drawings for describing the embodiments of the present invention are illustrative, the present invention is not limited to the illustrated items. In addition, in describing the present invention, when it is determined that the detailed description of a related known technology may unnecessarily obscure the gist of the present invention, detailed description thereof will be omitted. When the terms "comprise," "have," "consist of," etc. described in the present specification are used, other parts may be added unless "only" is used. When a component is expressed in the singular, it includes a case in which the component is provided as a plurality of components unless specifically stated otherwise.

In construing a component, the component is construed as including a margin of error even when there is no separate explicit description.

When a positional relationship is described, for example, when the positional relationship between two parts is described using the term "on," "above," "under," "next to," etc., one or more other parts may be positioned between the two parts unless the term "immediately" or "directly" is used.

The size and thickness of each component shown in the drawings are shown for convenience of description, and the present invention is not necessarily limited to the sizes and thicknesses of the components shown.

Features of various embodiments of the present invention can be partially or fully coupled or combined, and as can be fully understood by those skilled in the art, various technical interconnections and operations are possible, and the embodiments can be implemented independently of each other and implemented together in combination.

According to one embodiment, there is provided a cold and hot water supply and power generation system including a graphene-coated ceramic heating element 5, which includes a cold water tank 1 for accommodating water therein, a hot water tank 2 for accommodating water therein, a heat pump 3 for transferring heat from the cold water tank 1 to the hot water tank 2, a thermoelectric element unit 4 for generating power based on a temperature difference of the water accommodated in the cold water tank 1 and the hot water tank 2, the graphene-coated ceramic heating element 5 for heating the water accommodated in the hot water tank 2, and an energy storage system (ESS) 6 for storing the power generated by the thermoelectric element unit 4.

The cold water tank 1 and the hot water tank 2 may each be provided with an insulator to prevent heat loss and may store cold water and hot water therein, respectively.

Temperatures of the cold water and the hot water may vary depending on a design of a heat exchanger and the graphene-coated ceramic heating element 5, and to increase the efficiency of thermoelectric power generation, a temperature difference between the cold water and the hot water is preferably maintained in a range of 50 to 60° C.

The heat pump 3 preferably uses a product with a coefficient of performance (COP) of 3.5 or higher, and a compressor 31 compresses refrigerant and transfers heat from the cold water tank 1 to the hot water tank 2 through heat exchangers disposed at both sides (cold water side/hot water side). Since a general structure and configuration of the heat pump 3 is a known technology, detailed descriptions thereof will be omitted.

The thermoelectric element unit 4 (Peltier element unit) is in contact with each of the cold water accommodated in the cold water tank 1 and the hot water accommodated in the hot water tank 2 to generate electricity based on the temperature difference between the two water sources.

In this case, since it is difficult to form a large temperature difference (high hot water temperature) using only the heat pump 3, the graphene-coated ceramic heating element 5 for heating the water accommodated in the hot water tank 2 is included, and the water passing through the heat exchanger and having a higher temperature than before is additionally heated by the graphene-coated ceramic heating element 5.

Here, since the graphene-coated ceramic heating element 5 may be implemented based on a known technology such as Patent Document 1, detailed description thereof will be omitted.

The ESS 6 follows a known general configuration and may include components such as an inverter, a converter, a battery pack, and a control board.

In addition, the heat pump 3 may include the compressor 31 for compressing refrigerant, a first heat exchanger 32 connected to the compressor 31 and configured to transfer heat between water supplied from the cold water tank 1 and the refrigerant, a first water pipe 33 for supplying water from the cold water tank 1 to the first heat exchanger 32, a second water pipe 34 for supplying water passing through the first heat exchanger 32 to the cold water tank 1, a first pump connected to one side of the first water pipe 33 or the second water pipe 34, a second heat exchanger 35 connected to the compressor 31 and configured to transfer heat between water supplied from the hot water tank 2 and the refrigerant, a third water pipe 36 for supplying water from the hot water tank 2 to the second heat exchanger 35, a fourth water pipe 37 for supplying water passing through the second heat exchanger 35 to the graphene-coated ceramic heating element 5, a fifth water pipe 38 for supplying water passing through the graphene-coated ceramic heating element 5 to the hot water tank 2, and a second pump connected to one side of the third water pipe 36, the fourth water pipe 37, or the fifth water pipe 38, and the thermoelectric element unit 4 may include a thermoelectric element pad of which one surface is provided with a low-temperature portion 411 and the other surface is provided with a high-temperature portion 412, a first heat-conducting portion 421 attached to the low-temperature portion 411, a second heat-conducting portion 422 attached to the high-temperature portion 412, a first convection pipe 51 for receiving water through a lower portion of the cold water tank 1, passing through the first heat-conducting portion 421, and discharging the water to an upper portion of the cold water tank 1, a second convection pipe 52 for receiving water through an upper portion of the hot water tank 2, passing through the second heat-conducting portion 422, and discharging the water to a lower portion of the hot water tank 2, a third pump connected to the first convection pipe 51, and a fourth pump connected to the second convection pipe 52.

The refrigerant may be selected from known refrigerants according to appropriate temperatures of the cold water tank 1 and the hot water tank 2.

A predetermined refrigerant circuit and flow path may be formed between the compressor 31, the first heat exchanger 32, and the second heat exchanger 35.

The first heat exchanger 32 cools the water based on heat transfer between the refrigerant cooled to a lower temperature than the cold water and the water.

Water is transported from the cold water tank 1 to the first heat exchanger 32 through the first water pipe 33 to transfer heat, and after passing through the first heat exchanger 32, returns to the cold water tank 1 through the second water pipe 34.

Here, the water flows based on power of the first pump connected to the first water pipe 33 or the second water pipe 34.

The second heat exchanger 35 heats the water based on the heat transfer between the heated refrigerant and the water.

The water is transported from the hot water tank 2 to the second heat exchanger 35 through the third water pipe 36 to transfer heat, after passing through the second heat exchanger 35, is transported to the graphene-coated ceramic heating element 5 through the fourth water pipe 37 and heated, reaches a set temperature (higher temperature than a target temperature of hot water), and returns to the hot water tank 2 through the fifth water pipe 38.

Here, the water flows based on power of the second pump connected to one side of any of the third water pipe 36 to the fifth water pipe 38.

The thermoelectric element pad has one surface as a cooling surface and the other surface as a heating surface, and during thermoelectric power generation, the one surface serves as the low-temperature portion 411 and the other surface serves as the high-temperature portion 412.

Although thermoelectric power generation is possible only when hot water and cold water are each in contact with one of both surfaces of the thermoelectric element pad, since heat loss is very great when heat transfer between the cold water and the hot water occurs due to the very close arrangement of the cold water tank 1 and the hot water tank 2, it is preferable that water be taken out of each of the cold water tank 1 and the hot water tank 2 and be in contact with each of the low-temperature portion 411 and the high-temperature portion 412 of the thermoelectric element pad.

In the description of the present invention, a commercially available "thermoelectric element" is referred to as a "thermoelectric element pad." "The thermoelectric element unit 4" is a thermoelectric power generation system having a plurality (hundreds) of thermoelectric element pads.

The first heat-conducting portion 421 and the second heat-conducting portion 422 may each be preferably made of a metal with high thermal conductivity, such as copper or aluminum, and the low-temperature portion 411 and the high-temperature portion 412 may each be coated with thermal grease, etc. and then attached to the first heat-conducting portion 421 and the second heat-conducting portion 422.

In this case, the first heat-conducting portion 421 and the second heat-conducting portion 422 may each be provided independently or provided for each individual thermoelectric element pad.

A predetermined pipe and through hole are formed at one sides of the first heat-conducting portion 421 and the second heat-conducting portion 422 so that water may flow therethrough, and water flows through the pipes of the first heat-conducting portion 421 and the second heat-conducting portion 422 to cool and heat the low-temperature portion 411 and the high-temperature portion 412 to the temperatures of cold water and hot water.

The third pump and the fourth pump supply water to the first heat-conducting portion 421 and the second heat-conducting portion 422 through the first convection pipe 51 and the second convection pipe 52, respectively.

In addition, a plurality of thermoelectric element pads may be disposed in a lattice shape of a predetermined m×n size (m, n: natural numbers), the first convection pipe 51 may include a 1-1 convection pipe 511 extending upward from a lower portion of the cold water tank 1, 1-2 convection pipes 512 branched from an end portion of the 1-1 convection pipe 511 into m pipes, disposed horizontally so that each branched pipe corresponds to any one row of the thermoelectric element pad, and passing through the first heat-conducting portion 421, and a 1-3 convection pipe 513 merged from end portions of the plurality of 1-2 convection pipes 512 and extending to be connected to the upper portion of the cold water tank 1, and the second convection pipe 52 may include a 2-1 convection pipe 521 extending downward from an upper portion of the hot water tank 2, 2-2 convection pipes 522 branched from an end portion of the 2-1 convection pipe 521 into m pipes, disposed horizontally so that each branched pipe corresponds to any one row of the thermoelectric element pad, and passing through the second heat-conducting portion 422, and a 2-3 convection pipe 523 merged from end portions of the plurality of 2-2 convection pipes 522 and extending to be connected to the lower portion of the hot water tank 2.

Here, the "lattice shape" is a shape in which a plurality (hundreds) of thermoelectric element pads are arranged in m rows and n columns.

For example, in an embodiment in which 300 thermoelectric element pads are provided, the thermoelectric element pads may be disposed in 20 rows and 15 columns.

Figure 3:
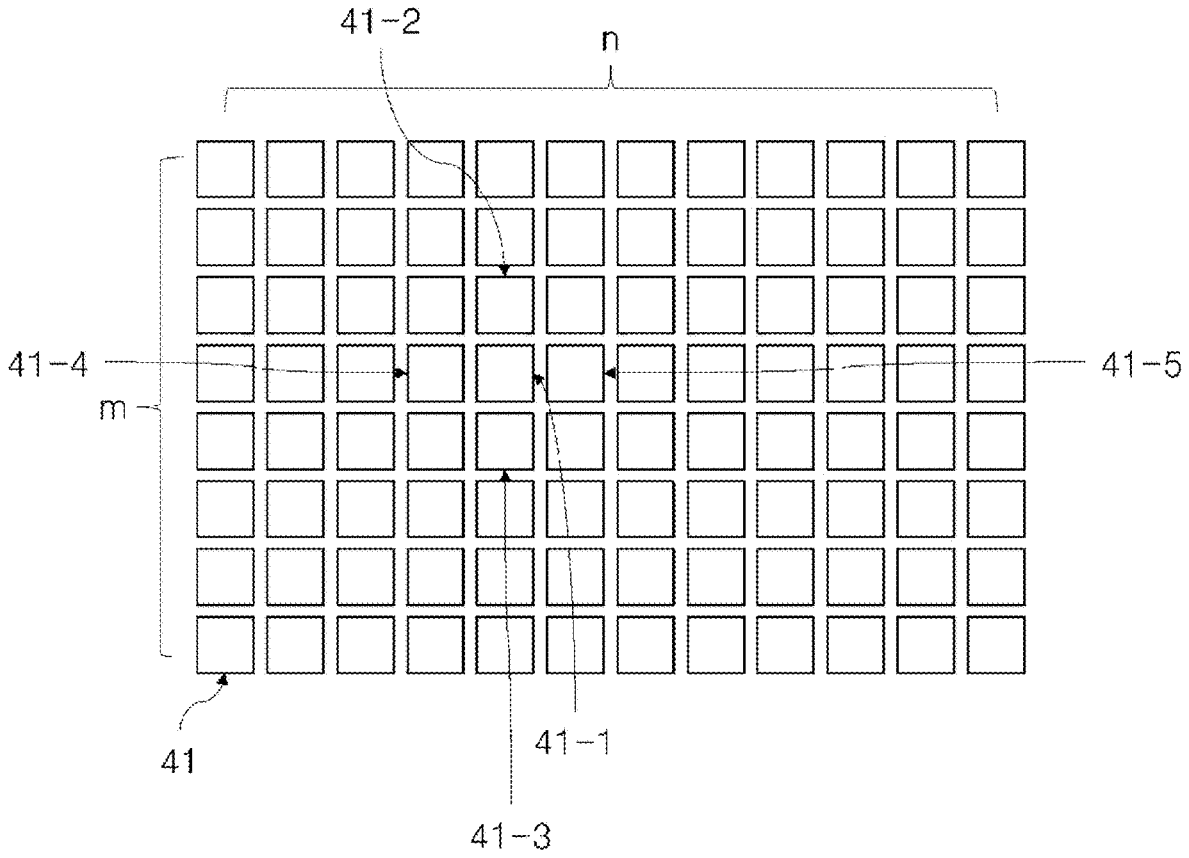
FIG. 3 is a view showing a thermoelectric element pad (lattice shape) of the cold and hot water supply and power generation system including the graphene-coated ceramic heating element according to one embodiment of the present invention.
Figure 4:
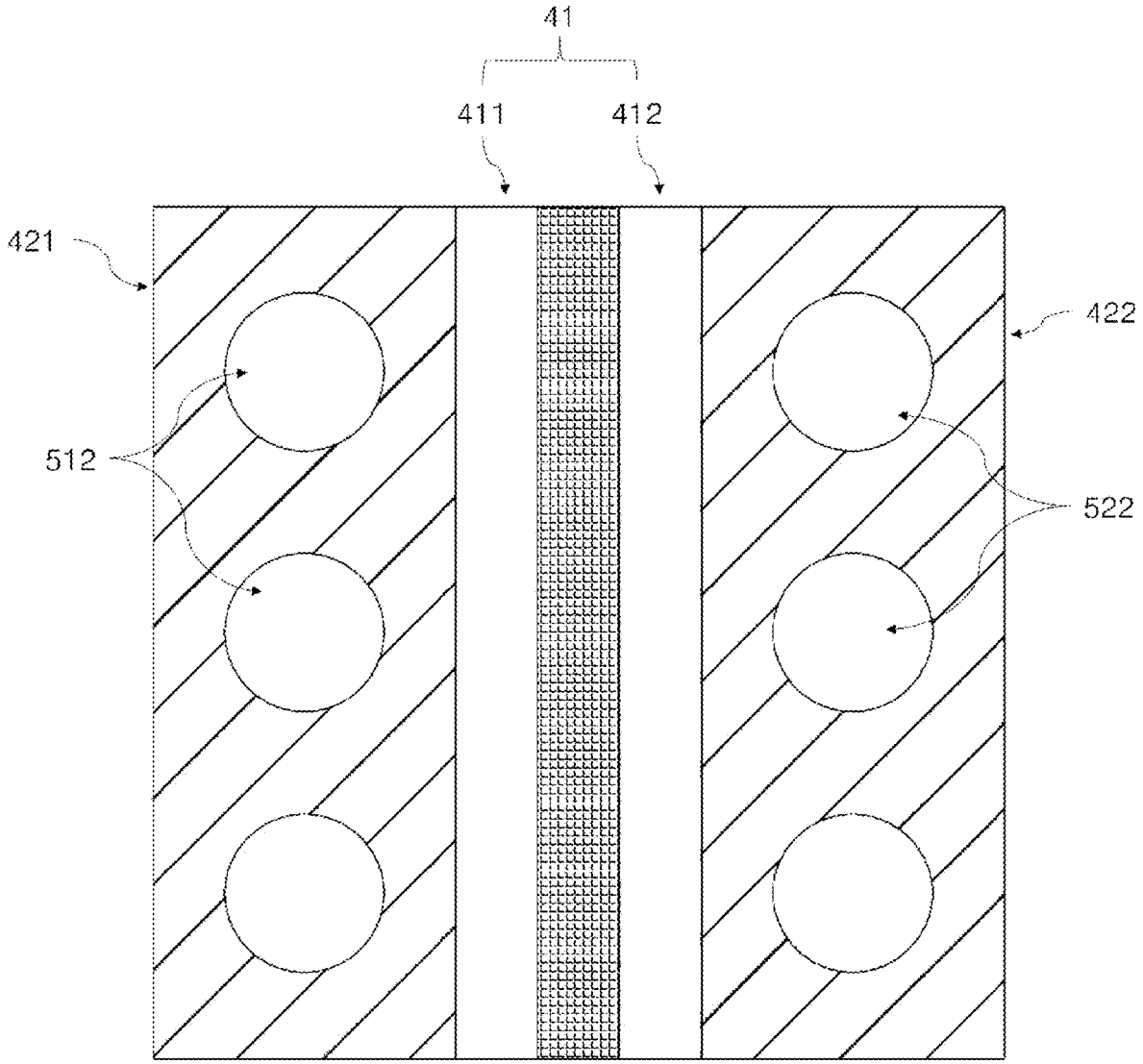
FIG. 4 is a side cross-sectional view showing a thermoelectric element unit of the cold and hot water supply and power generation system including the graphene-coated ceramic heating element according to one embodiment of the present invention.
Figure 5:
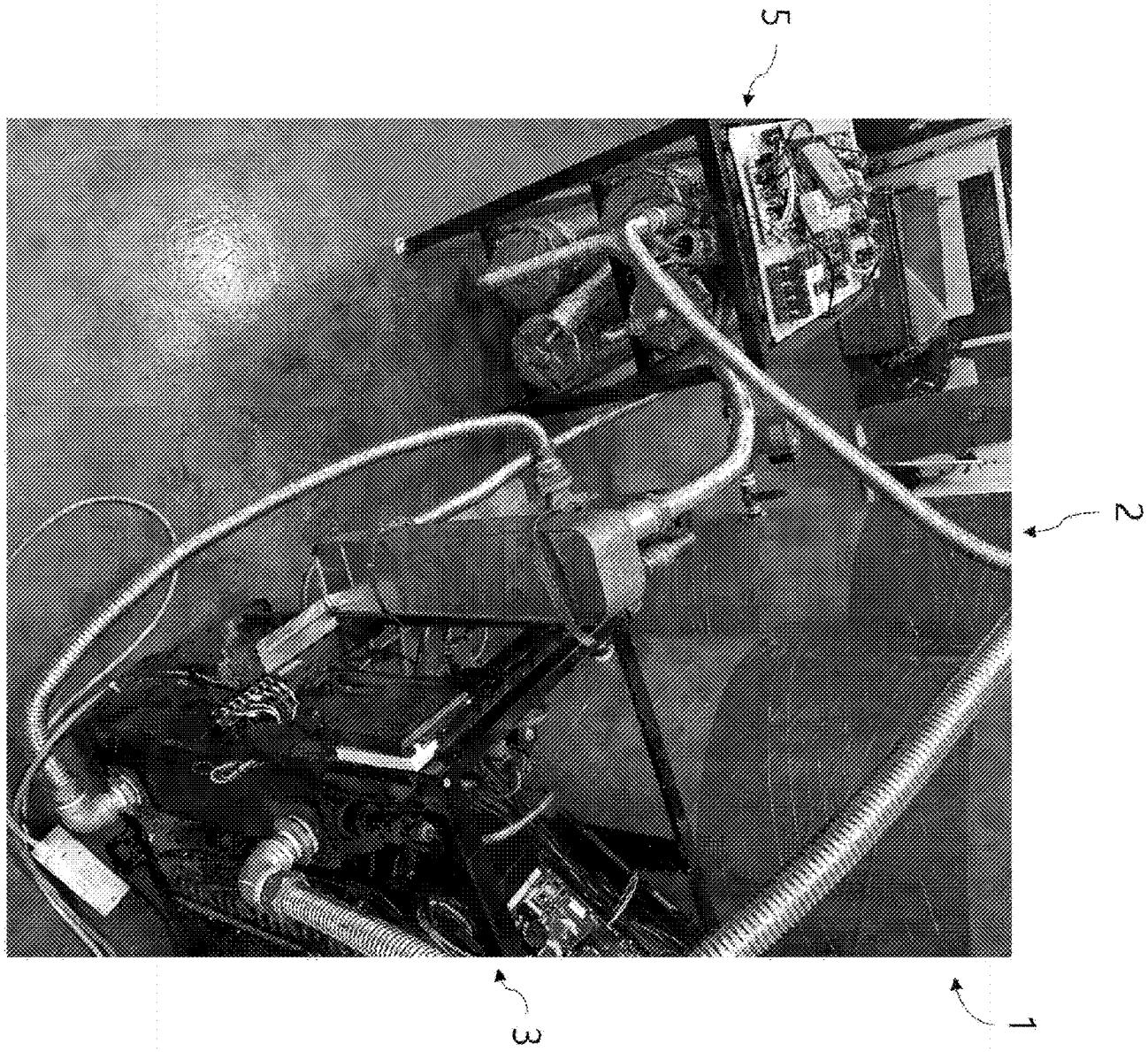
FIG. 5 is a picture showing the cold and hot water supply and power generation system including the graphene-coated ceramic heating element according to one embodiment of the present invention.

The thermoelectric element pads disposed in the lattice shape are shown in FIG. 3 (8×12 size).

The first convection pipe 51 cools the low-temperature portion 411 by allowing water discharged through the 1-1 convection pipe 511, which is a single pipe extending upward from the lower portion of the cold water tank 1, to flow to the 1-2 convection pipes 512 branched into m pipes (the number of rows of the lattice) and configured as m pipes horizontally and to pass through the first heat-conducting portion 421.

Since water with a lower temperature is disposed at the bottom of the cold water tank 1 due to natural convection, it is possible to maximize a temperature difference at the thermoelectric element pad by allowing the water with the lower temperature to pass through the first heat-conducting portion 421.

In this case, it is preferable that the 1-2 convection pipe 512 be formed integrally with the first heat-conducting portion 421 or be in close contact with the first heat-conducting portion 421 and made of a metal material with high thermal conductivity.

The water passing through the 1-2 convection pipe 512 is re-merged and returned to the cold water tank 1 through the 1-3 convection pipe 513.

The second convection pipe 52 heats the high-temperature portion 412 by allowing water discharged through the 2-1 convection pipe 521, which is a single pipe extending downward from the upper portion of the hot water tank 2, to flow to the 2-2 convection pipes 522 branched into m pipes (the number of rows of the lattice) and configured as m pipes horizontally and to pass through the second heat-conducting portion 422.

Since water with a higher temperature is disposed at the top of the hot water tank 2 due to natural convection, it is possible to maximize a temperature difference at the thermoelectric element pad by allowing the water with the higher temperature to pass through the second heat-conducting portion 422.

In this case, it is preferable that the 2-2 convection pipe 522 be formed integrally with the second heat-conducting portion 422 or be in close contact with the second heat-conducting portion 422 and made of a metal material with high thermal conductivity.

The water passing through the 2-2 convection pipe 522 is re-merged and returned to the hot water tank 2 through the 2-3 convection pipe 523.

In addition, the second convection pipe may include a voltage measurement unit for measuring a voltage of each of the thermoelectric element pads, and a controller connected to the voltage measurement unit to monitor the thermoelectric element unit 4.

The voltage measurement unit may calculate the amount of power generation by measuring a voltage and measuring a current flowing inside a thermoelectric element circuit.

The controller may be controlled according to a control method including measuring a voltage of each of the thermoelectric element pads corresponding to a unique number specified for each of the thermoelectric element pads, verifying failure for each thermoelectric element pad column, verifying failure for each thermoelectric element pad row, verifying failure of the thermoelectric element pad based on a neighboring thermoelectric element pad, monitoring the amount of power generated from all of the thermoelectric element pads, and controlling the graphene-coated ceramic heating element 5 and the first pump to the fourth pump based on the amount of power generation.

The unique number of each thermoelectric element pad may store information about at which point the thermoelectric element pad is disposed (coordinates) in the lattice shape (m×n matrix).

For example, among 300 thermoelectric element pads disposed in a lattice shape of a 20×15 size, a thermoelectric element pad disposed in row 3 and column 10 may have a unique number of "0310" (the first two digits indicate a row location and the last two digits indicate a column location).

The verifying of the failure for each thermoelectric element pad column may include: a first column verifying operation of specifying the 1-1 thermoelectric element pads disposed in the same column among the thermoelectric element pads disposed in the lattice shape based on the unique number; when the 1-2 thermoelectric element pads disposed at left sides of the 1-1 thermoelectric element pads with respect to the 1-1 thermoelectric element pads are present, a second column verifying operation of calculating a 1-1 ratio by comparing a total voltage of the 1-1 thermoelectric element pads with a total voltage of the 1-2 thermoelectric element pads; when the 1-3 thermoelectric element pads disposed at right sides of the 1-1 thermoelectric element pads with respect to the 1-1 thermoelectric element pads are present, a third column verifying operation of calculating a 1-2 ratio by comparing the total voltage of the 1-1 thermoelectric element pads with a total voltage of the 1-3 thermoelectric element pads; when the 1-1 ratio and the 1-2 ratio exceed a predetermined 1-1 reference ratio and 1-2 reference ratio, respectively, a fourth column verifying operation of recording, as defect verification targets, the unique numbers of the 1-1 thermoelectric element pads; and a first repetition operation of repeatedly performing the first column verifying operation to the fourth column verifying operation on all columns of the thermoelectric element pad lattice.

The first column verifying operation includes grouping the thermoelectric element pads by column based on the unique numbers of the thermoelectric element pads.

For example, among 300 thermoelectric element pads disposed in a lattice shape of a 20×15 size, 20 thermoelectric element pads disposed in a first column are specified (grouped) as the 1-1 thermoelectric element pads.

Then, when a thermoelectric element pad is present at the left side of each of the 1-1 thermoelectric element pads, the thermoelectric element pads are specified as the 1-2 thermoelectric element pads, and the second column verifying operation is performed.

When there are no 1-2 thermoelectric element pads, the second column verifying operation is omitted.

The second column verifying operation includes calculating the 1-1 ratio by comparing "the total voltage of the 1-1 thermoelectric element pads" with "the total voltage of the 1-2 thermoelectric element pads."

For example, by comparing a total voltage of the thermoelectric element pads in column 3 with a total voltage of the thermoelectric element pads in column 2, a voltage difference in column may be calculated as the 1-1 ratio.

Then, when a thermoelectric element pad is present at the right side of each of the 1-1 thermoelectric element pads, the thermoelectric element pads are specified as the 1-3 thermoelectric element pads, and the third column verifying operation is performed.

When there are no 1-3 thermoelectric element pads, the third column verifying operation is omitted.

The third column verifying operation includes calculating the 1-2 ratio by comparing "the total voltage of the 1-1 thermoelectric element pads" with "the total voltage of the 1-3 thermoelectric element pads."

For example, by comparing a total voltage of the thermoelectric element pads in column 3 with a total voltage of the thermoelectric element pads in column 4, a voltage difference in column may be calculated as the 1-2 ratio.

When both the 1-1 ratio and the 1-2 ratio are calculated and the 1-1 ratio and the 1-2 ratio exceed the 1-1 reference ratio and the 1-2 reference ratio, respectively, that is, when the 1-1 ratio exceeds the 1-1 reference ratio and the 1-2 ratio exceeds the 1-2 reference ratio, it may be determined that the corresponding column is a column having a large voltage difference compared to both left columns and right columns thereof and thus is abnormal.

The fourth column verifying operation includes recording, as defect verification targets, the 1-1 thermoelectric element pads in the corresponding column.

Then, the first repetition operation is performed so that the above-described operations may be performed on all columns to extract and record the defect verification targets.

The verifying of the failure for each thermoelectric element pad row may include: a first row verifying operation of specifying the 2-1 thermoelectric element pads disposed in the same row among the thermoelectric element pads disposed in the lattice shape based on the unique number; when the 2-2 thermoelectric element pads disposed above the 2-1 thermoelectric element pads with respect to the 2-1 thermoelectric element pads are present, a second row verifying operation of calculating a 2-1 ratio by comparing a total voltage of the 2-1 thermoelectric element pads with a total voltage of the 2-2 thermoelectric element pads; when the 2-3 thermoelectric element pads disposed under the 2-1 thermoelectric element pads with respect to the 2-1 thermoelectric element pads are present, a third row verifying operation of calculating a 2-2 ratio by comparing the total voltage of the 2-1 thermoelectric element pads with a total voltage of the 2-3 thermoelectric element pads; when the 2-1 ratio and the 2-2 ratio exceed a predetermined 2-1 reference ratio and 2-2 reference ratio, respectively, a fourth row verifying operation of recording, as defect verification targets, the unique numbers of the 2-1 thermoelectric element pads; and a second repetition operation of repeatedly performing the first row verifying operation to the fourth row verifying operation on all rows of the thermoelectric element pad lattice based on the unique number.

The verifying of the failure for each thermoelectric element pad row may be performed in the same manner by referring to the above detailed description of the verifying of the failure for each thermoelectric element pad column (performed by switching the column and the row in the description).

The verifying of the failure of the thermoelectric element pad may include: a first adjacency verifying operation of recording, as defect verification targets, thermoelectric element pads disposed at an outermost portion among the thermoelectric element pads disposed in the lattice shape based on the unique number; a second adjacency verifying operation of specifying a 3-1 thermoelectric element pad 41-1, which is any one of the thermoelectric element pads recorded as the defect verification targets based on the unique number; when a 3-2 thermoelectric element pad 41-2 disposed above the 3-1 thermoelectric element pad 41-1 with respect to the 3-1 thermoelectric element pad 41-1 is present, a third adjacency verifying operation of calculating a 3-1 ratio by comparing a voltage of the 3-1 thermoelectric element pad 41-1 with a voltage of the 3-2 thermoelectric element pad 41-2; when a 3-3 thermoelectric element pad 41-3 disposed under the 3-1 thermoelectric pad 41-1 with respect to the 3-1 thermoelectric element pad 41-1 is present, a fourth adjacency verifying operation of calculating a 3-2 ratio by comparing a voltage of the 3-1 thermoelectric element pad 41-1 with a voltage of the 3-3 thermoelectric element pad 41-3; when a 3-4 thermoelectric element pad 41-4 disposed at a left side of the 3-1 thermoelectric pad 41-1 with respect to the 3-1 thermoelectric element pad 41-1 is present, a fifth adjacency verifying operation of calculating a 3-3 ratio by comparing a voltage of the 3-1 thermoelectric element pad 41-1 with a voltage of the 3-4 thermoelectric element pad 41-4; when a 3-5 thermoelectric element pad 41-5 disposed at a right side of the 3-1 thermoelectric pad 41-1 with respect to the 3-1 thermoelectric element pad 41-1 is present, a sixth adjacency verifying operation of calculating a 3-4 ratio by comparing a voltage of the 3-1 thermoelectric element pad 41-1 with a voltage of the 3-5 thermoelectric element pad 41-5; when all calculated values of the 3-1 ratio to the 3-4 ratio exceed a predetermined 3-1 reference ratio to 3-4 reference ratio, a seventh adjacency verifying operation of recording, as a defect, the unique number of the 3-1 thermoelectric element pad 41-1; and a third repetition operation of repeatedly performing the first adjacency verifying operation to the seventh adjacency verifying operation on all thermoelectric element pads based on the unique number.

The first adjacency verifying operation includes specifying, as the defect verification targets, all outermost rows/columns that have not been recorded as the defect verification targets in the above-described operations.

For example, among 300 thermoelectric element pads disposed in a lattice shape of a 20×15 size, thermoelectric element pads included in column 1, column 15, row 1, and row 20 are specified as the defect verification targets.

The second adjacency verifying operation includes extracting any one of a defect verification target list and specifying the extracted one as the 3-1 thermoelectric element pad 41-1.

Then, when another thermoelectric element pad is located above the 3-1 thermoelectric element pad 41-1, another thermoelectric element pad is specified as the 3-2 thermoelectric element pad 41-2; when another thermoelectric element pad is located under the 3-1 thermoelectric element pad 41-1, another thermoelectric element pad is specified as the 3-3 thermoelectric element pad 41-3; when another thermoelectric element pad is located at the left side of the 3-1 thermoelectric element pad 41-1, another thermoelectric element pad is specified as the 3-4 thermoelectric element pad; and when another thermoelectric element pad is located at the right side of the 3-1 thermoelectric element pad 41-1, another thermoelectric element pad is specified as the 3-5 thermoelectric element pad 41-5.

When the 3-2 thermoelectric element pad 41-2 is present, the third adjacency verifying operation of calculating the 3-1 ratio by comparing the voltage of the 3-1 thermoelectric element pad 41-1 with the voltage of the 3-2 thermoelectric element pad 41-2 is performed.

When the 3-3 thermoelectric element pad 41-3 is present, the fourth adjacency verifying operation of calculating the 3-2 ratio by comparing the voltage of the 3-1 thermoelectric element pad 41-1 with the voltage of the 3-3 thermoelectric element pad 41-3 is performed.

When the 3-4 thermoelectric element pad 41-4 is present, the fifth adjacency verifying operation of calculating the 3-3 ratio by comparing the voltage of the 3-1 thermoelectric element pad 41-1 with the voltage of the 3-4 thermoelectric element pad 41-4 is performed.

When the 3-5 thermoelectric element pad 41-5 is present, the sixth adjacency verifying operation of calculating the 3-4 ratio by comparing the voltage of the 3-1 thermoelectric element pad 41-1 with the voltage of the 3-5 thermoelectric element pad 41-5 is performed.

In this case, when the thermoelectric element pad disposed at the outermost portion is specified as the 3-1 thermoelectric element pad 41-1, one or two of the 3-1 ratio to the 3-4 ratio may not be calculated.

Regardless of whether some of the 3-1 ratio to the 3-4 ratio have been calculated, when all of the calculated values exceed the predetermined 3-1 reference ratio to 3-4 reference ratio, it may be determined that the 3-1 thermoelectric element pad 41-1 is defective.

For example, when the 3-1 ratio is not calculated in a state in which the thermoelectric element pad disposed in row 1 and column 3 has been specified as the 3-1 thermoelectric element pad 41-1 and the 3-2 ratio to the 3-4 ratio exceed the 3-2 reference ratio to the 3-4 reference ratio, respectively, it may be determined that the thermoelectric element pad disposed in row 1 and column 3 is defective.

The third repetition operation includes performing the adjacency verifying operations once on all thermoelectric element pads included in the defect verification target list.

In addition, the cold water tank 1 and the hot water tank 2 may each be provided with a temperature sensor to measure and monitor the temperatures of the cold water and the hot water.

The controlling of the graphene-coated ceramic heating element 5 and the first pump to the fourth pump may include: when the amount of power generation measured from all thermoelectric element pads is less than a first reference, adjusting a set temperature of the graphene-coated ceramic heating element 5 to a first temperature; when the amount of power generation measured from all thermoelectric element pads is the first reference or more and less than a second reference, adjusting the set temperature of the graphene-coated ceramic heating element 5 to a second temperature; when the amount of power generation measured from all thermoelectric element pads is the second reference or more and less than a third reference, adjusting the set temperature of the graphene-coated ceramic heating element 5 to a third temperature; when the amount of power generation measured from all thermoelectric element pads is the third reference or more, adjusting the set temperature of the graphene-coated ceramic heating element 5 to a fourth temperature; when operating times of the third pump and the fourth pump are less than a fourth reference, adjusting output power of each of the third pump and the fourth pump to a first RPM; when the operating times of the third pump and the fourth pump are the fourth reference or more, adjusting the output power of each of the third pump and the fourth pump to a second RPM; when a water temperature inside the cold water tank 1 is lower than a fifth reference, adjusting output power of the first pump to a third RPM; when the water temperature inside the cold water tank 1 is the fifth reference or higher, adjusting the output power of the first pump to a fourth RPM; when a water temperature inside the hot water tank 2 is lower than a sixth reference, adjusting output power of the second pump to a fifth RPM; and when the water temperature inside the hot water tank 2 is the sixth reference or higher, adjusting the output power of the second pump to a sixth RPM.

When the amount of power generation measured from all thermoelectric element pads is less than the first reference, in the adjusting of the set temperature of the graphene-coated ceramic heating element 5 to the first temperature, when the total amount of power generation is less than the first reference (the lowest reference value), it is possible to maximize a temperature difference between cold water and hot water by adjusting the set temperature of the graphene-coated ceramic heating element 5 to the first temperature (maximum set temperature).

"First reference<second reference<third reference" are numerically specified, and the third reference is the minimum power generation when the system operates normally.

Therefore, "first temperature>second temperature>third temperature>fourth temperature" are specified, and the fourth temperature is a set temperature of the graphene-coated ceramic heating element 5 when the system operates normally and in a steady state.

As described above, when the amount of power generation is not sufficient, the set temperature of the graphene-coated ceramic heating element 5 may be increased to increase the temperature of the hot water and increase the temperature difference between hot water and cold water, thereby increasing the amount of power generation.

When the operating times of the third pump and the fourth pump are less than the fourth reference, in the adjusting of the output power of each of the third pump and the fourth pump to the first RPM, since the temperatures of the cold water and the hot water are not transferred to the low-temperature portion 411 and the high-temperature portion 412 of the thermoelectric element pad shortly after the system starts operating, the third pump and the fourth pump are operated at high output power to adjust the temperatures of the low-temperature portion 411 and the high-temperature portion 412 of the thermoelectric element pad.

"The first RPM>the second RPM" are numerically specified, and the second RPM is the output power of each of the third pump and the fourth pump in the steady-state.

When the water temperature inside the cold water tank 1 is lower than the fifth reference, in the adjusting of the output power of the first pump to the third RPM, when the water temperature (cold water temperature) inside the cold water tank 1 is lower than a specified value, the first pump is operated at the third RPM because the system operates normally.

"The third RPM<the fourth RPM" are numerically specified, and the third RPM is the output power of the first pump in the steady-state.

When the water temperature inside the hot water tank 2 is lower than the sixth reference, in the adjusting of the output power of the second pump to the fifth RPM, when the water temperature (hot water temperature) inside the hot water tank 2 is lower than a specified value, the second pump is operated at the fifth RPM because the hot water temperature is lower than the specified value.

"The fifth RPM>the sixth RPM" are numerically specified, and the sixth RPM is the output power of the second pump in the steady-state.

Although embodiments of the present invention have been described in more detail with reference to the accompanying drawings, the present invention is not necessarily limited to these embodiments, and various modifications may be carried out without departing from the technical spirit of the present invention. Therefore, the embodiments disclosed in the present invention are not intended to limit the technical spirit of the present invention, but intended to describe the same, and the scope of the technical spirit of the present invention is not limited by these embodiments. Therefore, it should be understood that the above-described embodiments are illustrative and not restrictive in all aspects. The scope of the present invention should be construed from the appended claims, and all technical spirits within the equivalent scope should be construed as being included in the scope of the present invention.

Therefore, other implementations, other embodiments, and equivalents of the claims also fall within the scope of the appended claims.

The invention claimed is:

1. A cold and hot water supply and power generation system including a graphene-coated ceramic water heater, the cold and hot water supply and power generation system comprising:

a cold water tank configured to accommodate water therein;

a hot water tank configured to accommodate water therein;

a heat pump configured to transfer heat from the cold water tank to the hot water tank;

a thermoelectric element unit configured to generate power based on a temperature difference in the water accommodated in the cold water tank and the hot water tank;

the graphene-coated ceramic water heater configured to heat the water accommodated in the hot water tank; and an energy storage system (ESS) configured to store the power generated by the thermoelectric element unit, wherein the heat pump includes:

a compressor configured to compress refrigerant;

a first heat exchanger connected to the compressor and configured to transfer heat between the water supplied from the cold water tank and the refrigerant;

a first water pipe configured to supply the water from the cold water tank to the first heat exchanger;

a second water pipe configured to supply the water passing through the first heat exchanger to the cold water tank;

a first pump connected to one side of the first water pipe or the second water pipe;

a second heat exchanger connected to the compressor and configured to transfer heat between the water supplied from the hot water tank and the refrigerant;

a third water pipe configured to supply the water from the hot water tank to the second heat exchanger;

a fourth water pipe configured to supply the water passing through the second heat exchanger to the graphene-coated heater;

a fifth water pipe configured to supply the water passing through the graphene-coated ceramic water heater to the hot water tank; and a second pump connected to one side of the third water pipe, the fourth water pipe, or the fifth water pipe, the thermoelectric element unit includes:

a plurality of thermoelectric element pads, wherein each of the plurality of thermoelectric element pads includes a low-temperature portion on one surface and a high-temperature portion on another surface, wherein the temperature of the low-temperature portion is lower than that of the high-temperature portion;

a first heat-conducting portion attached to the low-temperature portion;

a second heat-conducting portion attached to the high-temperature portion;

a first convection pipe configured to receive the water through a lower portion of the cold water tank, pass through the first heat-conducting portion, and discharge the water to an upper portion of the cold water tank;

a second convection pipe configured to receive the water through an upper portion of the hot water tank, pass through the second heat-conducting portion, and discharge the water to a lower portion of the hot water tank;

a third pump connected to the first convection pipe; and a fourth pump connected to the second convection pipe, and the plurality of thermoelectric element pads are disposed in a lattice shape of a m×n size, wherein m indicates the number of rows thereof and n indicates the number of columns thereof, wherein the first convection pipe includes:

a first convection pipe extending upward from the lower portion of the cold water tank;

a plurality of second convection pipes branched from an end portion of the first convection pipe into pipes, disposed horizontally so that each branched pipe corresponds to any one row of the plurality of thermoelectric element pads, and passing through the first heat-conducting portion; and a third convection pipe merged from end portions of the plurality of second convection pipes and extending to be connected to the upper portion of the cold water tank, the second convection pipe includes:

a fourth convection pipe extending downward from the upper portion of the hot water tank;

a plurality of fifth convection pipes branched from an end portion of the fourth convection pipe into pipes, disposed horizontally so that each branched pipe corresponds to any one row of the plurality of thermoelectric element pads, and passing through the second heat-conducting portion; and a sixth convection pipe merged from end portions of the plurality of fifth convection pipes and extending to be connected to the lower portion of the hot water tank, and the cold and hot water supply and power generation system includes:

a voltage measurement unit configured to measure a voltage of each of the thermoelectric element pads; and a controller connected to the voltage measurement unit to monitor the thermoelectric element unit, wherein the controller is controlled according to a control method including:

measuring the voltage of each of the plurality of thermoelectric element pads corresponding to a unique number specified on each of the plurality of thermoelectric element pads;

verifying failure for each thermoelectric element pad column;

verifying failure for each thermoelectric element pad row;

verifying failure of each of the plurality of thermoelectric element pads based on a neighboring thermoelectric element pad;

monitoring an amount of power generated from the plurality of thermoelectric element pads; and controlling the graphene-coated ceramic water heater and the first pump, the second pump, the third pump, and the fourth pump based on the amount of power generation, wherein the verifying of the failure for each thermoelectric element pad column includes:

a first column verifying operation of specifying first thermoelectric element pads disposed in the same column among the plurality of thermoelectric element pads disposed in the lattice shape based on the unique number;

when second thermoelectric element pads disposed at left sides of the first thermoelectric element pads with respect to the first thermoelectric element pads are present, a second column verifying operation of calculating a first ratio by comparing a total voltage of the first thermoelectric element pads with a total voltage of the second thermoelectric element pads;

when third thermoelectric element pads disposed at right sides of the first thermoelectric element pads with respect to the first thermoelectric element pads are present, a third column verifying operation of calculating a second ratio by comparing the total voltage of the first thermoelectric element pads with a total voltage of the third thermoelectric element pads;

when the first ratio and the second ratio exceed a first reference ratio and a second reference ratio, respectively, a fourth column verifying operation of recording unique numbers of the first thermoelectric element pads as defect verification targets; and a first repetition operation of repeatedly performing the first column verifying operation to the fourth column verifying operation on all columns of the plurality of thermoelectric element pads based on the unique number, wherein the verifying of the failure for each thermoelectric element pad row includes:

a first row verifying operation of specifying fourth thermoelectric element pads disposed in the same row among the plurality of thermoelectric element pads disposed in the lattice shape based on the unique number;

when fifth thermoelectric element pads disposed above the fourth thermoelectric element pads with respect to the fourth thermoelectric element pads are present, a second row verifying operation of calculating a third ratio by comparing a total voltage of the fourth thermoelectric element pads with a total voltage of the fifth thermoelectric element pads;

when sixth thermoelectric element pads disposed under the fourth thermoelectric element pads with respect to the fourth thermoelectric element pads are present, a third row verifying operation of calculating a fourth ratio by comparing the total voltage of the fourth thermoelectric element pads with a total voltage of the sixth thermoelectric element pads;

when the third ratio and the fourth ratio exceed a predetermined third reference ratio and a fourth reference ratio, respectively, a fourth row verifying operation of recording unique numbers of the fourth thermoelectric element pads as defect verification targets; and a second repetition operation of repeatedly performing the first row verifying operation to the fourth row verifying operation on all rows of the plurality of thermoelectric element pads based on the unique number, wherein the verifying of the failure of each of the plurality of thermoelectric element pads includes:

a first adjacency verifying operation of recording thermoelectric element pads disposed at an outermost portion among the plurality of thermoelectric element pads disposed in the lattice shape based on the unique number as defect verification targets;

a second adjacency verifying operation of specifying a seventh thermoelectric element pad that is any one of the plurality of thermoelectric element pads recorded as the defect verification targets based on the unique number;

when an eighth thermoelectric element pad disposed above the seventh thermoelectric element pad with respect to the seventh thermoelectric element pad is present, a third adjacency verifying operation of calculating a fifth ratio by comparing a voltage of the seventh thermoelectric element pad with a voltage of the eighth thermoelectric element pad;

when a ninth thermoelectric element pad disposed under the seventh thermoelectric element pad with respect to the seventh thermoelectric element pad is present, a fourth adjacency verifying operation of calculating a sixth ratio by comparing the voltage of the seventh thermoelectric element pad with a voltage of the ninth thermoelectric element pad;

when a tenth thermoelectric element pad disposed at a left side of the seventh thermoelectric element pad with respect to the seventh thermoelectric element pad is present, a fifth adjacency verifying operation of calculating a seventh ratio by comparing the voltage of the seventh thermoelectric element pad with a voltage of the tenth thermoelectric element pad;

when a eleventh thermoelectric element pad disposed at a right side of the seventh thermoelectric element pad with respect to the seventh thermoelectric element pad is present, a sixth adjacency verifying operation of calculating an eighth ratio by comparing the voltage of the seventh thermoelectric element pad with a voltage of the eighth thermoelectric element pad;

when all of the calculated values of the fifth ratio to the eighth ratio exceed a predetermined fifth reference ratio, a sixth reference ratio, a seventh reference ratio, and an eighth reference ratio, a seventh adjacency verifying operation of recording a unique number of the seventh thermoelectric element pad as defect; and a third repetition operation of repeatedly performing the first adjacency verifying operation to the seventh adjacency verifying operation on all the plurality of thermoelectric element pads based on the unique number, wherein the cold water tank and the hot water tank are each provided with a temperature sensor, and wherein the controlling of the graphene-coated ceramic water heater and the first pump, the second pump, the third pump, and the fourth pump includes:

when the amount of power generation measured from all the plurality of thermoelectric element pads is less than a first reference, adjusting a set temperature of the graphene-coated ceramic water heater to a first temperature;

when the amount of power generation measured from all the plurality of thermoelectric element pads is the first reference or more and less than a second reference, adjusting the set temperature of the graphene-coated ceramic water heater to a second temperature;

when the amount of power generation measured from all the plurality of thermoelectric element pads is the second reference or more and less than a third reference, adjusting the set temperature of the graphene-coated ceramic water heater to a third temperature;

when the amount of power generation measured from all the plurality of thermoelectric element pads is the third reference or more, adjusting the set temperature of the graphene-coated ceramic water heater to a fourth temperature;

when operating times of the third pump and the fourth pump are less than a fourth reference, adjusting output power of each of the third pump and the fourth pump to a first RPM;

when the operating times of the third pump and the fourth pump are the fourth reference or more, adjusting the output power of each of the third pump and the fourth pump to a second RPM;

when a water temperature inside the cold water tank is lower than a fifth reference, adjusting output power of the first pump to a third RPM;

when the water temperature inside the cold water tank is the fifth reference or higher, adjusting the output power of the first pump to a fourth RPM;

when a water temperature inside the hot water tank is lower than a sixth reference, adjusting output power of the second pump to a fifth RPM; and when the water temperature inside the hot water tank is the sixth reference or higher, adjusting the output power of the second pump to a sixth RPM.

* * * * *